US010222075B2

(12) United States Patent
Tsuji et al.

(10) Patent No.: US 10,222,075 B2
(45) Date of Patent: Mar. 5, 2019

(54) AIR-CONDITIONING SYSTEM AND TRANSMISSION RELAYING APPARATUS THEREOF

(71) Applicant: Mitsubishi Electric Corporation, Tokyo (JP)

(72) Inventors: Takayuki Tsuji, Tokyo (JP); Koji Rikukawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 336 days.

(21) Appl. No.: 15/111,192

(22) PCT Filed: Mar. 24, 2014

(86) PCT No.: PCT/JP2014/058012

§ 371 (c)(1),
(2) Date: Jul. 13, 2016

(87) PCT Pub. No.: WO2015/145528

PCT Pub. Date: Oct. 1, 2015

(65) Prior Publication Data

US 2016/0327304 A1 Nov. 10, 2016

(51) Int. Cl.
*F24F 1/00* (2011.01)
*F24F 1/0003* (2019.01)
(Continued)

(52) U.S. Cl.
CPC ..... *F24F 1/0003* (2013.01); *F24F 11/30* (2018.01); *F24F 11/89* (2018.01); *F24F 11/32* (2018.01);
(Continued)

(58) Field of Classification Search
USPC ..... 324/511.509
See application file for complete search history.

(56) References Cited

U.S. PATENT DOCUMENTS 5,029,330 A * 7/1991 Kajigaya ..... G11C 11/408 365/201
6,279,332 B1 * 8/2001 Yeo ..... F24F 1/0003 62/125
2012/0101778 A1 * 4/2012 Gyota ..... F24F 11/0086 702/183

FOREIGN PATENT DOCUMENTS

JP S60-074839 A 4/1985
JP H03-042934 A 2/1991
(Continued)

OTHER PUBLICATIONS

Office Action dated Dec. 6, 2016 issued in corresponding JP patent application No. 2016-509629 (and English translation).
(Continued)

*Primary Examiner* — Vincent Q Nguyen
(74) *Attorney, Agent, or Firm* — Posz Law Group, PLC

(57) ABSTRACT

A transmission relaying apparatus includes a signal receiving unit receiving a signal, transmitted from a transmission path, as a received signal; an abnormality detection unit detecting whether abnormality occurs in the received signal; and a threshold setting unit setting a preset threshold to be used for detection of abnormality by the abnormality detection unit. The threshold setting unit includes a peak value detection unit detecting a peak value of the signal level of the test signal received as the received signal by the signal receiving unit, when a test signal is output from a communication diagnostic apparatus; a threshold obtaining unit obtaining the preset threshold based on the peak value detected by the peak value detection unit; and a threshold holding unit storing the preset threshold, obtained by the threshold obtaining unit, as a preset threshold to be used by the abnormality detection unit.

10 Claims, 4 Drawing Sheets

(51) Int. Cl.

| | |
|---|---|
| ***F24F 11/30*** | (2018.01) |
| ***F24F 11/89*** | (2018.01) |
| *F24F 110/00* | (2018.01) |
| *F24F 11/32* | (2018.01) |
| *F24F 11/64* | (2018.01) |
| *F24F 11/56* | (2018.01) |

(52) U.S. Cl.
CPC ..... *F24F 11/56* (2018.01); *F24F 11/64* (2018.01); *F24F 2110/00* (2018.01)

(56) References Cited

FOREIGN PATENT DOCUMENTS

| | | | |
|---|---|---|---|
| JP | H05-268228 | A | 10/1993 |
| JP | H07-071806 | A | 3/1995 |
| JP | H08-035716 | A | 2/1996 |
| JP | 2006-064307 | A | 3/2006 |
| JP | 2006-207946 | A | 8/2006 |
| JP | 2010-121865 | A | 6/2010 |
| JP | 2011-145014 | A | 7/2011 |

OTHER PUBLICATIONS

International Search Report of the International Searching Authority dated Jul. 1, 2014 for the corresponding international application No. PCT/JP2014/058012 (and English translation).

* cited by examiner

PRIOR ART

AIR-CONDITIONING SYSTEM AND TRANSMISSION RELAYING APPARATUS THEREOF

CROSS REFERENCE TO RELATED APPLICATION

This application is a U.S. national stage application of PCT/JP2014/058012 filed on Mar. 24, 2014, the contents of which are incorporated herein by reference.

TECHNICAL FIELD

The present invention relates to an air-conditioning system in which an outdoor unit and an indoor unit are connected to each other in a manner capable of transmitting data via a transmission line, and a transmission relaying apparatus thereof.

BACKGROUND ART

An air-conditioning system in which an outdoor unit and an indoor unit are connected to each other in a manner capable of transmitting information via a transmission line has been known conventionally. The system is configured such that various types of signals such as control signals are transmitted and received via the transmission line. In such an air-conditioning system, as various types of signals are attenuated according to distance, a transmission relaying apparatus is interposed in the transmission line to perform a relaying process such as shaping of signals being transmitted on the transmission line. The transmission relaying apparatus includes a comparator (H/W) configured to compare a signal flowing on the network with a predetermined reception threshold voltage, and determine whether to perform shaping and relaying of a received waveform.

Here, a controller of a refrigeration cycle apparatus configured to determine a margin with respect to a production standard such as confirmation of a transmission line length, in the air-conditioning system described above, has been proposed (see Patent Literature 1, for example). Patent literature 1 discloses a controller of a refrigeration cycle apparatus configured to transmit a small signal slightly larger than a standard value and compare a received signal, when the small signal is received, with a preset receiving threshold to thereby determine whether the state of the transmission line is normal and check whether there is a margin with respect to the environment such as noise.

CITATION LIST

Patent Literature

Patent Literature 1: Japanese Unexamined Patent Application Publication No. H08-35716

SUMMARY OF INVENTION

Technical Problem

The preset receiving threshold described above is a fixed value corresponding to the allowable maximum wiring length. As such, in the case of installation environment in which the transmission path length is short, the preset receiving threshold is too low relatively, so that when inverter noise, switching noise, or exogenous noise is superimposed on the peak value of a received signal, the peak value exceeds the preset receiving threshold due to the noise component. As such, abnormality in the received signal cannot be detected by the transmission relaying apparatus, and is relayed to another device, whereby communication abnormality may occur. On the other hand, when the preset receiving threshold is set to be higher, the maximum value (peak value) of a received signal may not be able to exceed the preset receiving threshold. As such, the communication may be determined to be abnormal, although it is normal.

The present invention has been made to solve the above-described problem. An object of the present invention is to provide an air-conditioning system and a transmission relaying apparatus thereof, capable of detecting and suppressing communication abnormality with high accuracy according to the installation environment.

Solution to Problem

An air-conditioning system of one embodiment of the present invention includes an outdoor unit; an indoor unit connected to the outdoor unit via a refrigerant pipe, the indoor unit being connected to the outdoor unit in a manner capable of transmitting data via a transmission path; a transmission relaying apparatus provided on the transmission path connecting the outdoor unit and the indoor unit, the transmission relaying apparatus being configured to relay a signal being transmitted on the transmission path; and a communication diagnostic apparatus connected to the outdoor unit, the indoor unit, and the transmission relaying apparatus in a manner capable of transmitting data via the transmission path, the communication diagnostic apparatus being configured to transmit a test signal onto the transmission path when a communication state is tested. The transmission relaying apparatus includes a signal receiving unit configured to receive a signal transmitted from the transmission path as a received signal; an abnormality detection unit configured to detect whether abnormality occurs in the received signal, based on the voltage value of the received signal received by the signal receiving unit and a preset threshold; and a threshold setting unit configured to set the preset threshold to be used for detection of abnormality by the abnormality detection unit. The threshold setting unit includes a peak value detection unit configured to, when the test signal is output from the communication diagnostic apparatus, detect a peak value of the signal level of the test signal received as the received signal by the signal receiving unit; a threshold obtaining unit configured to obtain the preset threshold based on the peak value detected by the peak value detection unit; and a threshold holding unit configured to store the preset threshold, obtained by the threshold obtaining unit, as the preset threshold to be used by the abnormality detection unit.

Advantageous Effects of Invention

According to the air-conditioning system of one embodiment of the present invention, as a preset threshold is automatically set based on the peak value of a reception waveform when a test signal is received, it is possible to determine communication abnormality by using a preset threshold according to the length of a transmission path where a transmission relaying apparatus is provided. Accordingly, communication abnormality due to installation environment can be suppressed.

DESCRIPTION OF EMBODIMENTS

Embodiment 1

Figure 1:
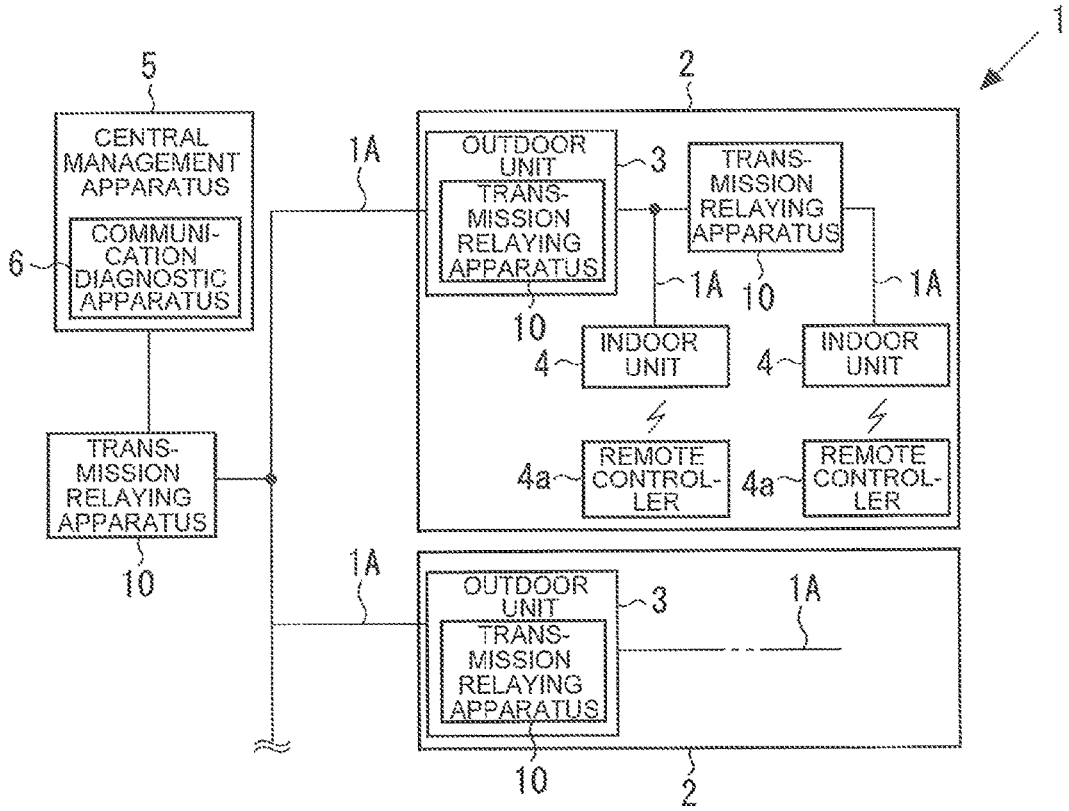
FIG. 1 is a schematic diagram for illustrating an air-conditioning system according to Embodiment 1 of the present invention.

Hereafter, an embodiment of an air-conditioning system of the present invention will be described with reference to the drawings. FIG. 1 is a system configuration diagram of an air-conditioning system 1 according to Embodiment 1 of the present invention. The air-conditioning system 1 in FIG. 1 manages operation of a refrigeration cycle apparatus 2, installed in a building or the like, by a central management apparatus 5. The air-conditioning system 1 includes two refrigeration cycle apparatuses 2, for example. Each of the refrigeration cycle apparatuses 2 includes an outdoor unit 3 and a plurality of indoor units 4, which are connected to each other by refrigerant pipes to constitute a refrigerant circuit. Each of the indoor units 4 is installed in a room, and is configured to perform heating and cooling of indoor air.

It should be noted that while FIG. 1 exemplary illustrates the case in which the air-conditioning system 1 has two refrigeration cycle apparatuses 2, it may have one refrigeration cycle apparatus 2, or three or more refrigeration cycle apparatuses. Further, while the case where the refrigeration cycle apparatus 2 has two indoor units 4 is exemplary illustrated, it may have at least one. Further, the indoor units 4 may perform air conditioning of a common floor, or perform air conditioning of different floors.

The central management apparatus 5 has a function of monitoring the states of the refrigeration cycle apparatuses 2 and performing various types of operation control. The central management apparatus 5 is connected to each of the refrigeration cycle apparatuses 2 in a manner capable of transmitting data via a transmission path 1A. Specifically, the central management apparatus 5 is connected to each of the outdoor units 3 via the transmission path 1A, and with respect to each of the outdoor units 3, the indoor units 4 are connected in series, for example, via the transmission path 1A (daisy chain connection). The outdoor units 3, the indoor units 4, and the transmission relaying apparatuses 10 are assigned with different addresses (for example, 1 to 50), respectively. Based on the addresses, the central management apparatus 5 transmits control signals to the outdoor units 3 and the indoor units 4, or receives various types of signals transmitted from the units, respectively.

The air-conditioning system 1 of FIG. 1 also includes the transmission relaying apparatus 10 configured to perform processing such as shaping of signals transmitted through the transmission path 1A. This means that signal levels (signal voltage values) of various types of signals transmitted in the air-conditioning system 1 are attenuated according to the transmission distance on the transmission path 1A, and the noise entering the transmission path 1A may be superimposed depending on the installation environment. As such, the transmission relaying apparatus 10 has a function of performing waveform shaping on a received signal and outputting it to the downstream of the transmission path.

In FIG. 1, a plurality of transmission relaying apparatuses 10 are installed in the air-conditioning system 1, which are installed, for example, between the central management apparatus 5 and the outdoor unit 3, and between the outdoor unit 3 and the indoor unit 4, and also incorporated in the outdoor unit 3. It should be noted that the locations where the transmission relaying apparatuses 10 are installed are not limited to the installation locations illustrated in FIG. 1. They may be installed appropriately in locations where a relaying process such as shaping of signals is needed. Further, while the case in which the transmission relaying apparatus 10 is incorporated in the outdoor unit 3 is exemplary illustrated, it may be installed independent of the outdoor unit 3, or may be incorporated in the indoor unit 4.

Figure 2:
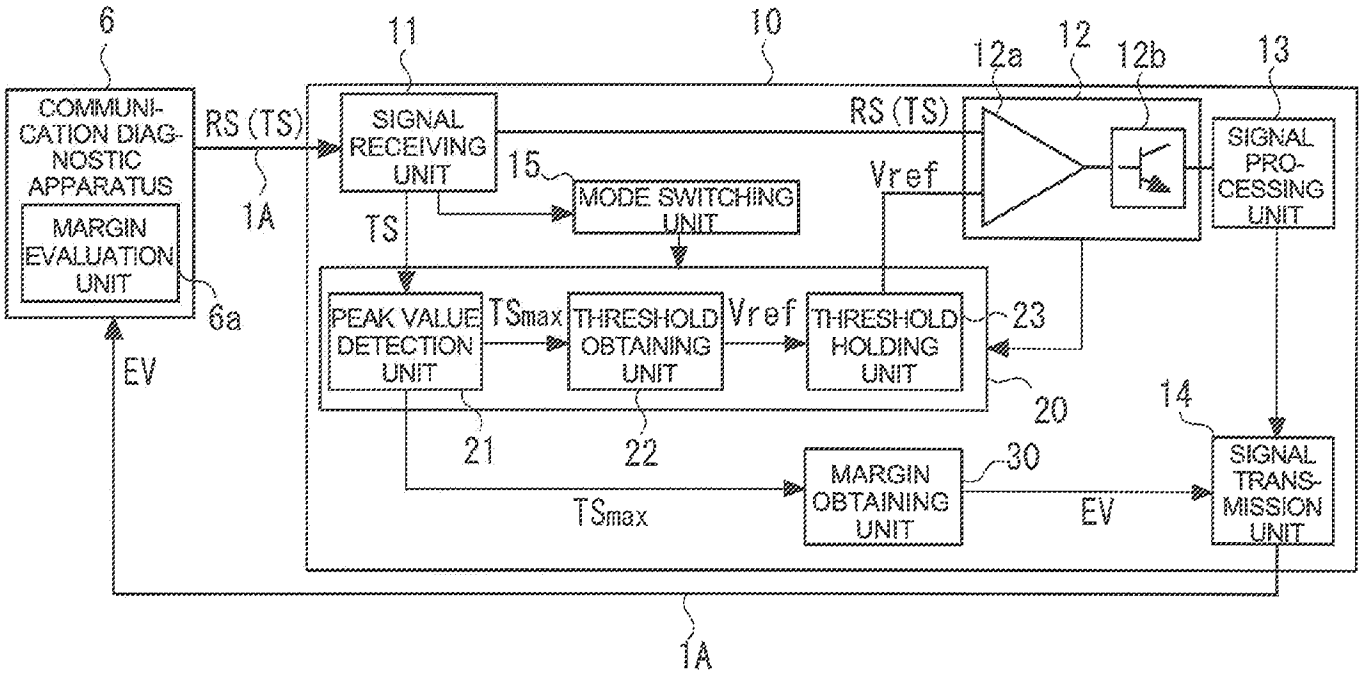
FIG. 2 is a block diagram for illustrating an exemplary transmission relaying apparatus of the air-conditioning system according to Embodiment 1 of the present invention.

FIG. 2 is a block diagram for illustrating an example of the transmission relaying apparatus according to Embodiment 1 of the present invention illustrated in FIG. 1. The transmission relaying apparatus 10 includes a signal receiving unit 11, an abnormality detection unit 12, a signal processing unit 13, and a signal transmission unit 14. The signal receiving unit 11 receives a signal transmitted from an upstream side device via the transmission path 1A, as a received signal RS.

The abnormality detection unit 12, configured to detect whether abnormality occurs in the received signal RS received by the signal receiving unit 11, includes a signal determination unit 12*a* and a signal blocking unit 12*b*. The signal determination unit 12*a* compares a signal level (signal voltage value) with a preset threshold Vref, and determines that the received signal RS is abnormal when the signal level is lower than the preset threshold Vref. On the other hand, when the signal level of the received signals RS is higher than the preset threshold Vref, the signal determination unit 12*a* determines that it is normal. It should be noted that the signal determination unit 12*a* performs abnormality determination using the preset threshold Vref stored in a threshold holding unit 23.

The signal blocking unit 12*b* is configured such that when abnormality is detected in the received signal RS by the signal determination unit 12*a*, the signal blocking unit 12*b* blocks transmission of the signal to the downstream side, and analyses the received signal RS or stops the relaying process. It should be noted that when blocking the received signal RS, the signal blocking unit 12*b* may transmit information of occurrence of abnormality to the central management apparatus 5.

Regarding the received signal RS determined to be normal by the abnormality detection unit 12, the signal processing unit 13 performs various types of signal processing such as shaping of the received signal RS and removal of noise components. Then, the received signal RS, on which signal processing is performed by the signal processing unit 13, is transmitted from the signal transmission unit 14 to the downstream side of the transmission path 1A, or transmitted to, for example, a controller of the outdoor unit 3.

In this example, the preset threshold Vref, used by the signal determination unit 12*a* described above, is automatically set by the transmission relaying apparatus 10 at the time of performing trial operation or at the time of test mode for performing maintenance. This means that as the transmission path length from the central management apparatus 5 to the transmission relaying apparatus 10 differs depending on the installation location of the transmission relaying apparatus 10, the attenuation level of the received signal RS received by each transmission relaying apparatus 10 differs depending on each transmission relaying apparatus 10. Further, noise components included in the received signal RS, received by each transmission relaying apparatus 10, differs depending on the installation location of the transmission relaying apparatus 10, installation position of the transmission path, or the like. Accordingly, if a common preset threshold Vref is used in all transmission relaying apparatuses 10 installed in the air-conditioning system 1, the accuracy of abnormality determination will be degraded. As such, the transmission relaying apparatus 10 has a function of automatically optimizing the preset threshold Vref (automatic setting mode) to secure transmission quality, when an installation contractor or a maintenance agency performs trial operation, maintenance, or the like of the air-conditioning system 1.

Specifically, the air-conditioning system 1 includes a communication diagnostic apparatus 6 for diagnosing a communication state at the time of trial operation or the like. The communication diagnostic apparatus 6 is connected to the outdoor unit 3, the indoor unit 4 and the transmission relaying apparatus 10 in a manner capable of transmitting data via the transmission path 1A, and is configured to transmit a test signal TS onto the transmission path 1A at the time of testing the communication state. In FIG. 1, the communication diagnostic apparatus 6 is incorporated, for example, in the central management apparatus 5, and is configured to be able to transmit and receive various types of signals by using the same transmission path 1A as that of the central management apparatus 5. It should be noted that while FIG. 1 exemplary illustrates the case in which the communication diagnostic apparatus 6 is incorporated in the central management apparatus 5, it may be connected to the transmission path 1A as a device independent of the central management apparatus 5.

Then, when an operator operates the communication diagnostic apparatus 6 to start the test mode, the communication diagnostic apparatus 6 outputs a test signal TS for diagnosing a communication state at the test mode. The test signal TS includes a signal level (voltage value) slightly larger than, for example, the standard value of the product.

Meanwhile, the transmission relaying apparatus 10 of FIG. 2 includes a mode switching unit 15 for switching the operation of the transmission relaying apparatus 10 at the time of test mode. The transmission relaying apparatus 10 has a function in which when the mode is switched to the test mode by the mode switching unit 15, the transmission relaying apparatus 10 automatically sets a preset threshold Vref. It should be noted that the mode switching unit 15 may be configured to start setting of the preset threshold Vref when it receives a signal to perform the test mode, or start setting of the preset threshold Vref after a command of automatic setting of a threshold is made by the communication diagnostic apparatus 6 in the test mode.

Specifically, the transmission relaying apparatus 10 includes a threshold setting unit 20 for setting a preset threshold to be used for abnormality detection by the abnormality detection unit 12. The threshold setting unit 20 includes a peak value detection unit 21, a threshold obtaining unit 22, and the threshold holding unit 23. The peak value detection unit 21 is configured such that when the test signal TS is output from the communication diagnostic apparatus 6, the peak value detection unit 21 detects a peak value (maximum value) TSmax of the signal level of the test signal TS received as a received signal RS by the signal receiving unit 11. For example, the peak value detection unit 21 acquires a value obtained by converting the analog value to the digital value with respect to a voltage value of the transmission waveform of the test signal TS. Then, the peak value detection unit 21 detects the largest value in the transmission waveform of the test signal TS as a peak value TSmax.

The threshold obtaining unit 22 obtains a preset threshold Vref based on the peak value TSmax detected by the peak value detection unit 21. The threshold holding unit 23 stores the preset threshold Vref obtained by the threshold obtaining unit 22 as a preset threshold Vref to be used by the abnormality detection unit. Specifically, the threshold obtaining unit 22 first stores, in the threshold holding unit 23, a value obtained by subtracting a predetermined voltage subtraction value $\alpha$ from the peak value TSmax, as a preset threshold Vref ($Vref=TSmax-\alpha$). Then, the abnormality detection unit 12 detects abnormality of the test signal TS with use of the preset threshold Vref stored in the threshold holding unit 23.

When the abnormality detection unit 12 determines that the test signal TS is normal, the threshold obtaining unit 22 obtains a preset threshold Vref obtained by further subtracting the voltage subtraction value $\alpha$ ($Vref=Vref-\alpha$), and the signal determination unit 12*a* determines whether the test signal TS is abnormal by using the newly obtained preset threshold Vref. The threshold obtaining unit 22 repeatedly performs processing to subtract the voltage subtraction value $\alpha$ from the preset threshold Vref until abnormality occurs.

On the other hand, when the abnormality detection unit 12 detects abnormality of the test signal TS, the threshold obtaining unit 22 stores, in the threshold holding unit 23, a preset threshold Vref obtained by adding a margin increase amount $\beta$to the preset threshold Vref stored in the threshold holding unit 23 ($Vref=Vref+\beta$), whereby automatic setting of the preset threshold Vref is completed. It should be noted that the margin increase amount $\beta$ is obtained by adding a certain value of error caused by dispersion, which may be the same value as the voltage subtraction value $\alpha$, or a value larger than it. As such, when subtraction of the voltage subtraction value $\alpha$ from the peak value TSmax is repeated N times, for example, a value obtained by subtracting $N\times\alpha$ from the peak value TSmax of the test signal TS and adding the margin increase amount $\beta$ is used as the preset threshold Vref ($Vref=TSmax-(N\times\alpha)+\beta$). Then, when the margin increase amount $\beta$ is the voltage subtraction value $\alpha$, it means that the value is returned to the preset threshold Vref immediately before the occurrence of the abnormality. The preset threshold Vref finally stored in the threshold holding unit 23 is transmitted to the communication diagnostic apparatus 6 via the signal transmission unit 14.

In this way, by automatically setting the preset threshold Vref based on the peak value TSmax in which dispersion is caused depending on the installation environment when the test signal TS is received, it is possible to determine communication abnormality in the received signal RS by using the optimum preset threshold Vref according to the installation environment of the air-conditioning system 1. As such, occurrence of communication abnormality due to installation environment can be suppressed. In particular, by adding a certain value of error caused by dispersion as a margin increase amount $\beta$ and by setting a voltage value $TSmax-(N-1)\times\alpha$, immediately before abnormality is determined, as a preset threshold Vref, it is possible to set a preset threshold Vref resistant to noise.

Further, the air-conditioning system 1 also includes a margin obtaining unit 30 configured to obtain a difference between the peak value TSmax, detected by the peak value detection unit 21, and the standard value TSref as a margin EV ($=TSref-TSmax$). It should be noted that while FIG. 2 exemplary illustrates the case in which the margin obtaining unit 30 is provided in the transmission relaying apparatus 10, it may be provided to the communication diagnostic apparatus 6 side. In that case, the transmission relaying apparatus 10 transmits the peak value TSmax to the communication diagnostic apparatus 6, and the margin obtaining unit 30 in the communication diagnostic apparatus 6 obtains the margin EV.

Meanwhile, the communication diagnostic apparatus 6 includes a margin evaluation unit 6*a* configured to compare the margin EV, obtained with respect to the transmission relaying apparatus 10, with an evaluation threshold EVref, and when the margin EV is smaller than the evaluation threshold EVref, the margin evaluation unit 6*a* gives a warning. By giving a warning as described above, it is possible to specify a part in which the transmission quality has a margin or a problem in the air-conditioning system 1. It should be noted that while the case in which the margin evaluation unit 6*a* performs evaluation using one evaluation threshold EVref is exemplary illustrated, it is possible to classify the margin EV into a plurality of stages by using a plurality of evaluation thresholds EVref. Further, the communication diagnostic apparatus 6 may have a function of displaying an abnormal state of each of the transmission relaying apparatuses 10, an address of the source where abnormality occurs, a current preset threshold Vref, a margin EV, and the like, on a monitor not shown.

Figure 3:
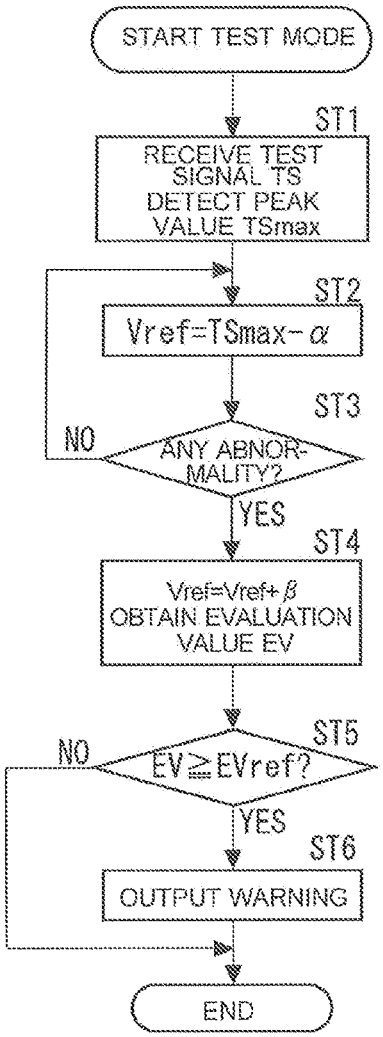
FIG. 3 is a flowchart for illustrating an exemplary operation of the transmission relaying apparatus illustrated in FIGS. 1 and 2.

FIG. 3 is a flowchart for illustrating an exemplary operation of the transmission relaying apparatus 10 shown in FIGS. 1 and 2. An exemplary operation of the transmission relaying apparatus 10 will be described with reference to FIGS. 1 to 3. First, when an instruction is made by an operator to the communication diagnostic apparatus 6 to diagnose communications, the communication diagnostic apparatus 6 instructs the transmission relaying apparatus 10 to switch the mode. Further, a test signal TS is output to the transmission path 1A with respect to the address of each device. Then, the mode of the transmission relaying apparatus 10 side is switched to the test mode by the mode switching unit 15, and the test signal TS is received by the signal receiving unit 11 and the peak value TSmax is detected (step ST1).

Then, by the threshold obtaining unit 22, a preset threshold Vref is obtained by subtracting the voltage subtraction value $\alpha$ from the peak value TSmax, and is stored in the threshold holding unit 23 (step ST2). Then, by the abnormality detection unit 12, detection of abnormality, using the obtained preset threshold Vref, is performed for a predetermined period (step ST3). Then, when no abnormality occurred in the test signal TS received during the predetermined period in the abnormality detection unit 12, by the threshold obtaining unit 22 of the threshold setting unit 20, the voltage subtraction value $\alpha$ is further subtracted from the preset threshold Vref stored in the threshold holding unit 23, and the value obtained through the subtraction is reset as the preset threshold Vref (step ST2). The subtraction processing of the preset threshold Vref described above is performed until abnormality is detected by the abnormality detection unit 12 (steps ST2 and ST3).

On the other hand, in Embodiment 1, when abnormality is detected by the abnormality detection unit 12 when the test signal TS is received during the predetermined period (step ST3), by the threshold obtaining unit 22, the preset threshold Vref ($=TSmax-N-60+\beta$) is obtained by adding the margin increase amount $\beta$ to the preset threshold Vref stored in the threshold holding unit 23 and stored in the threshold holding unit 23 (step ST4). Then, at the time of normal operation of the air-conditioning system 1, detection of abnormality of the received signal RS is performed by the abnormality detection unit 12 with use of the preset threshold Vref.

Further, by the margin obtaining unit 30, the margin EV is obtained based on the peak value TSmax, and is transmitted to the communication diagnostic apparatus 6. By the margin evaluation unit 6*a* of the communication diagnostic apparatus 6, it is determined whether the margin EV is equal to or greater than the evaluation threshold EVref (step ST5), and when the margin EV is smaller than the evaluation threshold EVref, a warning is given (step ST6).

According to Embodiment 1, by automatically setting the preset threshold Vref based on the peak value TSmax when the test signal TS is received, it is possible to determine communication abnormality of the received signal RS by using an optimum preset threshold Vref according to the installation environment of the air-conditioning system 1. As such, occurrence of communication abnormality due to installation environment can be suppressed.

Figure 4:
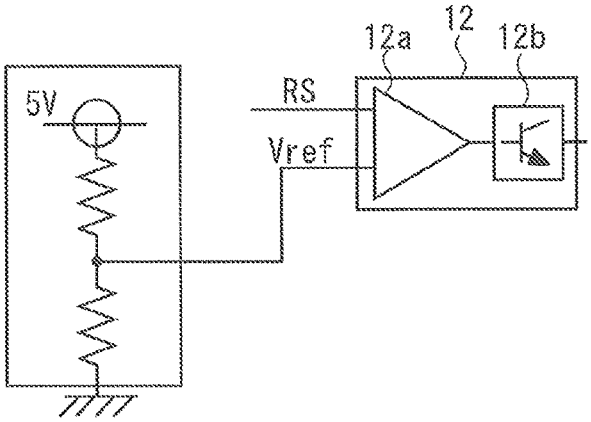
FIG. 4 is a schematic diagram for illustrating an example of a conventional threshold setting unit.

This means that as shown in the schematic diagram of FIG. 4 illustrating an example of a conventional threshold setting unit, the preset threshold Vref is designed to have a noise component of a predetermined value or less by using a noise filter such as a bypass capacitor with respect to expected noise, and determination of abnormality is performed using a fixed predetermined preset threshold Vref. However, regarding the transmission relaying apparatuses 10 of the air-conditioning system 1, the respective transmission path lengths from the central management apparatus 5 differ from each other, and the attenuation degrees of the received signal RS differ in the respective transmission relaying apparatuses 10. Further, even in the case in which two transmission relaying apparatuses 10 are installed at positions having the same transmission path length, for example, susceptibility to noise differs depending on the installation location, whereby the noise components included in the received signals RS differ from each other. As such, depending on the installation location of the transmission relaying apparatus 10, the fixed preset threshold Vref may be too high so that a normal received signal RS may be erroneously determined to be abnormal. Alternatively, the fixed preset threshold Vref may be too low so that a received signal RS having a large noise component may be erroneously determined to be a normal received signal RS.

On the other hand, in the transmission relaying apparatus 10 illustrated in FIGS. 1 to 3, it is possible to set a preset threshold Vref suitable for the installation location of each transmission relaying apparatus 10 at the time of trial operation mode or the like. As such, it is possible to determine communication abnormality of the received signal RS by using an optimum preset threshold Vref according to the system or the installation environment such as the length of a transmission path where the transmission relaying apparatus is provided. Thereby, occurrence of communication abnormality due to installation environment can be suppressed.

Further, as the margin obtaining unit 30 of the transmission relaying apparatus 10 obtains the margin EV, and the communication diagnostic apparatus 6 stores the margin and the address of the transmission relaying apparatus 10 in association with each other, it is possible to accurately recognize the communication quality of each transmission relaying apparatus 10. Particularly, when the margin EV is smaller than the predetermined evaluation threshold EVref, by outputting a warning to the display unit or the like, a maintenance operator or the like may immediately recognize the location where a problem of transmission quality is caused in the air-conditioning system 1.

Embodiment 2

Figure 5:
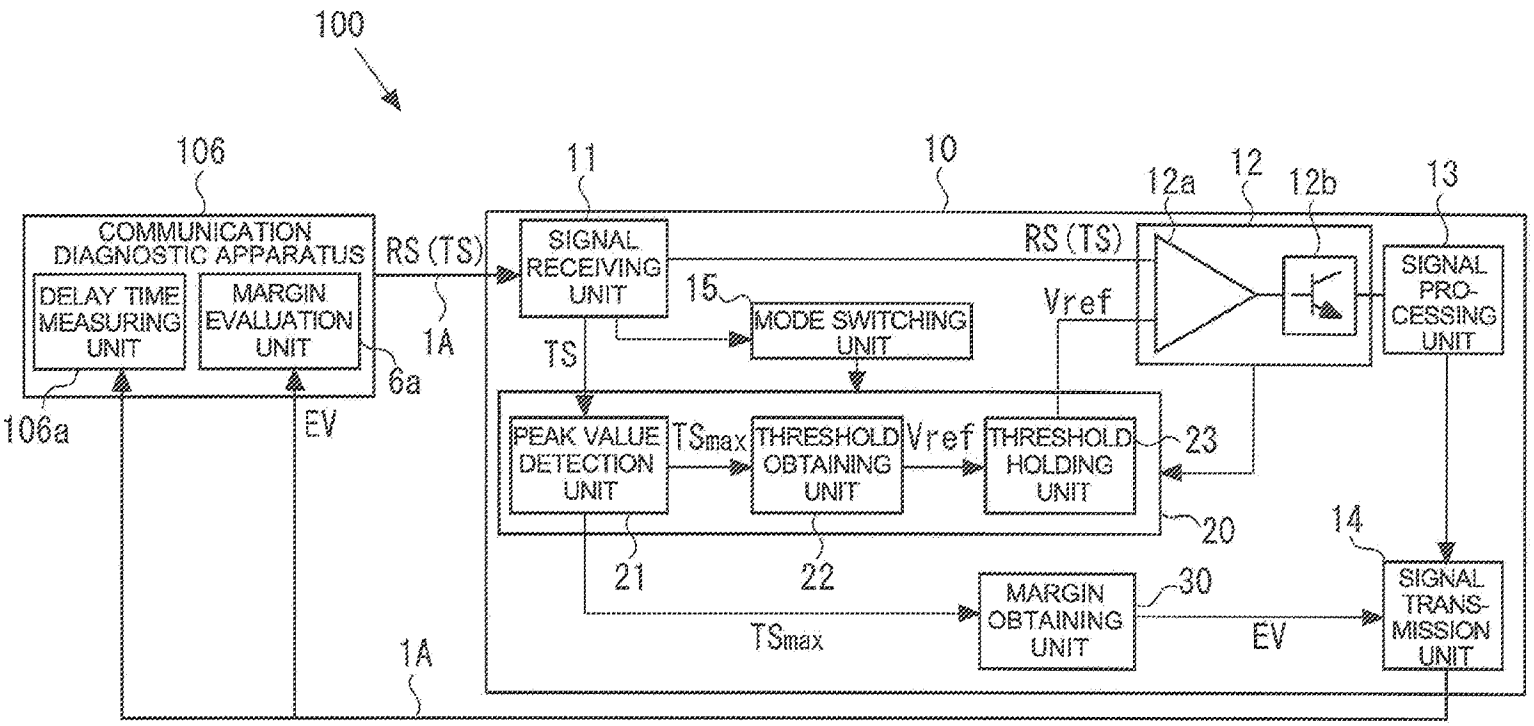
FIG. 5 is a block diagram for illustrating an air-conditioning system according to Embodiment 2 of the present invention.

FIG. 5 is a block diagram for illustrating a configuration of an air-conditioning system according to Embodiment 2 of the present invention. An air-conditioning system 100 will be described with reference to FIG. 5. It should be noted that in the air-conditioning system 100 of FIG. 5, parts having the same configurations as those in the air-conditioning system 1 of FIGS. 1 and 2 are denoted by the same reference numerals or characters and the description thereof is omitted. The point that the air-conditioning system 100 of FIG. 5 differs from the air-conditioning system 1 of FIGS. 1 and 2 is that a delay time measuring unit 106*a* is provided.

In FIG. 5, the delay time measuring unit 106*a* is incorporated, for example, in the communication diagnostic apparatus 106, and is configured to measure a transmission delay time until a response to a test signal TS is received after transmission of the test signal TS. Specifically, the delay time measuring unit 106*a* measures the time from transmission to reception of a response with respect to each address of all apparatuses constituting the air-conditioning system 1. In the delay time measuring unit 106*a*, a transmission time having been obtained based on the wiring length to each apparatus is stored in advance. Then, the delay time measuring unit 106*a* obtains a difference between the stored transmission time and the time until a response is made actually, as a transmission delay time.

In this way, by calculating a transmission delay time for each apparatus, it is possible to specify an apparatus of the address in which transmission delays. This enables maintenance operation to be performed efficiently.

It should be noted that even in FIG. 5, by automatically setting a preset threshold Vref based on the peak value TSmax when the test signal TS is received, it is possible to determine communication abnormality of a received signal RS with use of an optimum preset threshold Vref according to the installation environment of the air-conditioning system 1, as in the case of Embodiment 1. As such, occurrence of communication abnormality due to installation environment can be suppressed. Further, in FIG. 5, the communication diagnostic apparatus 106 is able to monitor abnormal states, an address of the source where abnormality occurs, a current preset threshold Vref, and a margin EV. Further, by giving a warning when the margin EV is less than a certain value, it is always possible to specify a place where transmission quality has a margin.

Embodiments of the present invention are not limited to the embodiments described above. For example, in Embodiments 1 and 2, the case of calculating a preset threshold by using one voltage subtraction value $\alpha$ in the test mode has been exemplary illustrated. However, to set a preset threshold Vref having higher accuracy, after setting a preset threshold Vref by using the voltage subtraction value $\alpha$, it is possible to use a voltage subtraction value smaller than the voltage subtraction value $\alpha$ to perform subtraction processing repeatedly until abnormality occurs, by the same method.

Further, when detecting a peak value TSmax of the test signal TS, the peak value detection unit may detect a peak value from one test signal TS, or detect a peak value TSmax from a plurality of test signals TS. In the case of detecting a peak value from a plurality of test signals TS, the peak value detection unit 21 may, for example, use an average value of a plurality of peak values TSmax, or detect a maximum value of a plurality of peak values TSmax as a peak value TSmax.

REFERENCE SIGNS LIST

1, 100 air-conditioning system 1A transmission path 2 refrigeration cycle apparatus 3 outdoor unit 4 indoor unit 5 central management apparatus

6, 106 communication diagnostic apparatus 6*a* margin evaluation unit

10 transmission relaying apparatus 11 signal receiving unit 12 abnormality detection unit 12*a* signal determination unit 12*b* signal blocking unit 13 signal processing unit 14 signal transmission unit 15 mode switching unit 20 threshold setting unit 21 peak value detection unit 22 threshold obtaining unit

23 threshold holding unit 30 margin obtaining unit 106 communication diagnostic apparatus 106*a* delay time measuring unit EV margin EVref evaluation threshold RS received signal Tref preset threshold TS test signal TSmax voltage value TSmax peak value TSref standard value Vref preset threshold $\alpha$ voltage subtraction value $\beta$ margin increase amount

The invention claimed is:

1. An air-conditioning system comprising:

an outdoor unit;

an indoor unit connected to the outdoor unit via a refrigerant pipe, the indoor unit being connected to the outdoor unit in a manner capable of transmitting data via a transmission path;

a communication diagnostic apparatus connected to the transmission path, and configured to transmit a test signal onto the transmission path when a communication state is tested; and a plurality of transmission relaying apparatuses provided to each of the outdoor unit, the indoor unit, and the transmission path, and configured to perform waveform shaping on a received signal and output the received signal, the plurality of transmission relaying apparatuses each being configured to receive a signal transmitted from the transmission path as the received signal, and to detect whether abnormality occurs in the received signal, based on a voltage value of the received signal and a preset threshold used for detecting an abnormality, the preset threshold being obtained based on a peak value of a signal level of the test signal received as the received signal and stored, the peak value being detected when the test signal is output from the communication diagnostic apparatus.

2. The air-conditioning system of claim 1, wherein the preset threshold is a value obtained by subtracting a predetermined voltage subtraction value from the peak value, and each of the plurality of transmission relaying apparatuses is configured to determine abnormality of the test signal with use of the preset threshold stored, to repeatedly perform processing of subtracting the voltage subtraction value from the preset threshold until abnormality is detected in the test signal, and to store the preset threshold obtained by adding an increase amount to the preset threshold when abnormality of the test signal is detected.

3. The air-conditioning system of claim 1, wherein each of the transmission relaying apparatuses is configured to obtain a difference between the preset threshold that is stored and a predetermined reference threshold, as a margin.

4. The air-conditioning system of claim 3, wherein the communication diagnostic apparatus is configured to output a warning when the margin is smaller than a predetermined evaluation threshold.

5. The air-conditioning system of claim 1, wherein each of the transmission relaying apparatuses is configured to measure a time taken until a response to the test signal is received after transmission of the test signal, and measure a transmission delay time based on the measured time and a transmission path length to the outdoor unit, the indoor unit, or a corresponding one of the plurality of transmission relaying apparatuses from which the test signal was transmitted.

6. The air-conditioning system of claim 5, wherein the communication diagnostic apparatus is configured to transmit the test signal to each of the plurality of transmission relaying apparatuses.

7. The method of claim 1, wherein transmitting the test signal from the communication diagnostic apparatus to each of the plurality of transmission relaying apparatuses.

8. The method of claim 7, wherein measuring a time taken until a response to the test signal is received after transmission of the test signal, and measuring a transmission delay time based on the measured time and a transmission path length to the outdoor unit, the indoor unit, or a corresponding one of the plurality of transmission relaying apparatuses from which the test signal was transmitted.

9. The air-conditioning system of claim 1, wherein the communication diagnostic apparatus is configured to transmit the test signal to each of the plurality of transmission relaying apparatuses.

10. A method for detecting abnormality by a plurality of transmission relaying apparatuses of an air-conditioning system including an outdoor unit, an indoor unit connected to the outdoor unit via a refrigerant pipe and connected to the outdoor unit in a manner capable of transmitting data via a transmission path, and a communication diagnostic apparatus connected to the transmission path and configured to transmit a test signal onto the transmission path, the plurality of transmission relaying apparatuses being provided to each of the outdoor unit, the indoor unit, and the transmission path, the method comprising:

receiving a signal transmitted from the transmission path as a received signal;

detecting a peak value of a signal level of the test signal received as the received signal, when the test signal is output from the communication diagnostic apparatus;

obtaining and storing a preset threshold based on the peak value; and detecting whether abnormality occurs in the received signal, based on a voltage value of the received signal and the preset threshold used for detecting an abnormality.

* * * * *